US009186899B2

(12) United States Patent
Ogata

(10) Patent No.: US 9,186,899 B2
(45) Date of Patent: Nov. 17, 2015

(54) INK JET PRINTING APPARATUS

(71) Applicant: CANON FINETECH INC., Misato-shi (JP)

(72) Inventor: Marie Ogata, Koshigaya (JP)

(73) Assignee: Canon Finetech, Inc., Misato-shi (JP)

( * ) Notice: Subject to any disclaimer, the term of this patent is extended or adjusted under 35 U.S.C. 154(b) by 0 days.

(21) Appl. No.: 14/160,959

(22) Filed: Jan. 22, 2014

(65) Prior Publication Data

US 2014/0210908 A1 Jul. 31, 2014

(30) Foreign Application Priority Data

Jan. 31, 2013 (JP) ..... 2013-017133

(51) Int. Cl.
*B41J 2/165* (2006.01)

(52) U.S. Cl.
CPC .... *B41J 2/16541* (2013.01); *B41J 2002/16582* (2013.01)

(58) Field of Classification Search
CPC ..... B41J 2/16526; B41J 2/16535; B41J 2/16538; B41J 2/16541; B41J 2/16547; B41J 2/16552; B41J 2/16585
USPC ..... 347/22, 33
See application file for complete search history.

(56) References Cited

U.S. PATENT DOCUMENTS 5,539,435 A * 7/1996 Uchida et al. ..... 347/33
5,548,310 A * 8/1996 Binnert et al. ..... 347/33
5,610,641 A * 3/1997 Ikado ..... 347/33
6,189,999 B1 2/2001 Pham et al.
2005/0146554 A1* 7/2005 Asanuma et al. ..... 347/33
2006/0268050 A1* 11/2006 Sonobe ..... 347/29
2007/0103505 A1* 5/2007 Takagi ..... 347/33
2008/0136857 A1* 6/2008 Ogasawara et al. ..... 347/18
2008/0286021 A1* 11/2008 Asami ..... 399/351

(Continued)

FOREIGN PATENT DOCUMENTS

JP 07-285226 A 10/1995
JP 2001-180013 A 7/2001

(Continued)

OTHER PUBLICATIONS

Japanese Office Action issued in Japanese Patent Application No. 2013-017133, dated Dec. 10, 2014.

(Continued)

*Primary Examiner* — Manish S Shah
*Assistant Examiner* — Roger W Pisha, II
(74) *Attorney, Agent, or Firm* — Fitzpatrick, Cella, Harper & Scinto

(57) ABSTRACT

An ink jet printing apparatus prints an image by employing a print head capable of ejecting ink through an ejection opening. The ink jet printing apparatus comprises: a blade having a distal end portion which wipes an ejection opening face of the print head where the ejection opening is formed; and a blade cleaner having a face which moves relatively to the bade in a predetermined direction while being in contact with the distal end portion of the blade. The face of the blade cleaner includes a plurality of inclined faces which are located by being shifted in the predetermined direction and inclined in the predetermined direction. The plurality of inclined faces have different inclination angles in the predetermined direction.

9 Claims, 10 Drawing Sheets

(56) References Cited

U.S. PATENT DOCUMENTS

| | | | | |
|---|---|---|---|---|
| 2009/0189945 | A1* | 7/2009 | Sekiyama | 347/33 |
| 2011/0234693 | A1* | 9/2011 | Yamaguchi et al. | 347/28 |

FOREIGN PATENT DOCUMENTS

| | | | |
|---|---|---|---|
| JP | 2008-055891 | A | 3/2008 |
| JP | 2010-99840 | A | 5/2010 |

OTHER PUBLICATIONS

Japanese Office Action issued in Japanese Patent Application No. 2013-017133, dated Sep. 8, 2015.

* cited by examiner

INK JET PRINTING APPARATUS

BACKGROUND OF THE INVENTION

1. Field of the Invention

The present invention relates to an ink jet printing apparatus that includes a blade that wipes an ejection face of a print head on which an ejection opening is formed, and a blade cleaner that cleans the blade.

2. Description of the Related Art

In an ink jet printing apparatus, a foreign substance, such as an ink droplet and dust (including a paper powder caused by a printing medium like a sheet of paper), may be attached to an ejection face of an ink jet print head on which an ejection opening is formed. In order to clean the ejection face of the print head, a flexible blade is employed to wipe the ejection face. Since the foreign substances attached to the ejection face are removed by using the blade, defective ink ejection through the ejection opening can be prevented.

The blade is a flexible plate member, and a distal end portion of the blade includes a top face located at the tip and side faces located on the respective sides of the blade in the direction of thickness. In a wiping operation, the blade is moved while the distal end is bent in contact with the ejection face. Accordingly, the foreign substance on the ejection face is collected by the distal end of the blade, and the ejection face is cleaned. However, there is a possibility that the foreign substance thus collected by the distal end of the blade may be attached again to the ejection face in the next wiping operation. Therefore, a blade cleaner for cleaning the blade is used to prevent re-attachment of the foreign substance.

An arrangement wherein the blade is bent and moved in contact with an inclined face of an ink absorber, serving as the blade cleaner, to remove the foreign substance from the distal end of the blade is described in Japanese Patent Laid-Open No. H07-285226 (1995) and Japanese Patent Laid-Open No. 2001-180013.

According to Japanese Patent Laid-Open No. H07-285226 (1995) and Japanese Patent Laid-Open No. 2001-180013, since the blade is moved with the distal end being bent in contact with the ink absorber, it is easy to remove the foreign substance from the side faces of the distal end of the blade. However, the foreign substance attached to the top face of the distal end is not easily removed.

SUMMARY OF THE INVENTION

The present invention provides an ink jet printing apparatus that can appropriately remove a foreign substance attached to a top face of a distal end of a blade.

In the aspect of the present invention, there provided an ink jet printing apparatus for printing an image by employing a print head capable of ejecting ink through an ejection opening, comprising: a blade having a distal end portion which wipes an ejection opening face of the print head where the ejection opening is formed; and a blade cleaner having a face which moves relatively to the bade in a predetermined direction while being in contact with the distal end portion of the blade, wherein the face of the blade cleaner includes a plurality of inclined faces which are located by being shifted in the predetermined direction and inclined in the predetermined direction, and wherein the plurality of inclined faces have different inclination angles in the predetermined direction.

According to the present invention, a state wherein the distal end of the blade is opposed to the plurality of inclined faces of the blade cleaner, which are located by being shifted in the direction in which the blade moves relative to the blade cleaner, is changed, and therefore, a foreign substance attached to the top face of the blade can be appropriately removed. As a result, the function of the blade can be fully exhibited to prevent the occurrence of defective ink ejection of the print head.

Further features of the present invention will become apparent from the following description of exemplary embodiments (with reference to the attached drawings).

DESCRIPTION OF THE EMBODIMENTS

The embodiments of the present invention will now be described based on the drawings.

First Embodiment

Figure 1:
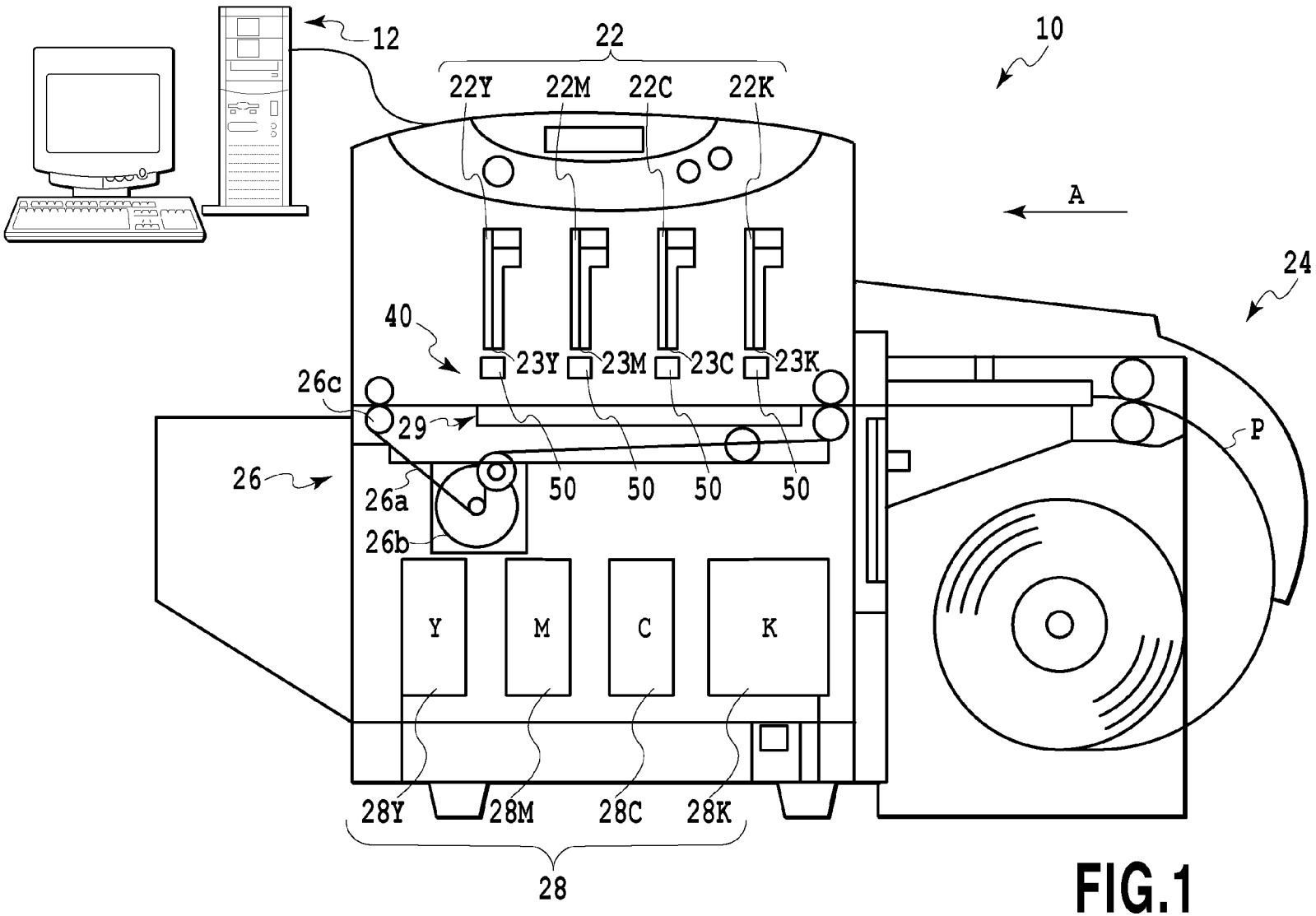
FIG. 1 is a schematic front view of the arrangement of an ink jet printing apparatus according to a first embodiment of the present invention.

FIG. 1 is a schematic front view of an ink jet printing apparatus according to a first embodiment of the invention. A printing apparatus 10 in this embodiment is a full-line type printer, and is connected to a host PC (host apparatus) 12. Based on printing information received from the host PC 12, four print heads 22 (22K, 22C, 22M and 22Y) of the printing apparatus 10 eject black, cyan, magenta and yellow inks, respectively, to print an image to rolled paper (printing medium) P.

The print heads 22 are elongate heads that are extended across an entire printing area of the rolled paper P in a widthwise direction, and in a direction that crosses a conveying direction A of the rolled paper P (in this embodiment, a perpendicular direction). The print head 22K that ejects black ink, the print head 22C that ejects cyan ink, the print head 22M that ejects magenta ink and the print head 22Y that ejects yellow ink are arranged in the named order in the conveying direction A. For each of the print heads 22, a plurality of nozzles for ink ejection are arranged in a direction that crosses the conveying direction A (in this embodiment, a perpendicular direction), and ejection energy generating elements, such as electrothermal transducing elements (heaters) or piezoelectric elements, are employed to eject ink from the nozzles. In a case wherein the electrothermal transducing element is employed, ink is bubbled by heat generated by the electrothermal transducing element, and bubbling energy is employed to eject ink from the ejection opening that are formed at a distal end of the nozzle. The ejection openings are formed on each of ejection faces 23 (23K, 23C, 23M and 23Y) of the individual print heads 22 (22K, 22C, 22M and 22Y).

Figure 3A:
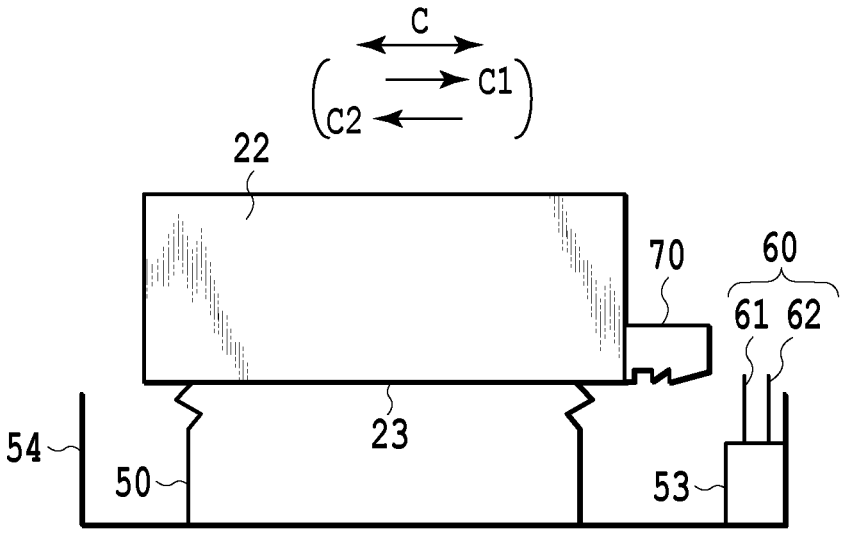
FIG. 3A is a schematic diagram showing a structure of a portion around a cap shown in FIG. 1.

The printing apparatus 10 includes a recovery unit 40 that maintains the print heads 22 in the satisfactory ink ejection state. Since the recovery unit 40 periodically cleans the ejection faces 23 of the print heads 22, the appropriate condition for ink ejection through the ejection openings of the print heads 22 can be maintained. The recovery unit 40 includes caps 50 that closely contact the ejection faces 23 of the individual print heads 22 during the cleaning operation (capping). The caps 50 are prepared for the individual print heads 22, and as shown in FIG. 3A, are located in a recovery gutter 54, together with a blade 60 and a blade holding member 53. Furthermore, blade cleaners 70 are provided for the individual print heads 22. The blade 60 and the blade cleaners 70 will be described later.

The rolled paper P is fed by a feeding unit 24, and is conveyed in a direction indicated by an arrow A by a conveying mechanism 26 incorporated in the printing apparatus 10. The conveying mechanism 26 includes a conveying belt 26*a*, along which the rolled paper P is conveyed, and a conveying motor 26*b*, which moves the conveying belt 26*a*, and rollers 26*c*, which apply a tension force to the conveying belt 26*a*. The conveying mechanism 26 also includes a suction mechanism (not shown) that draws air through suction holes (not shown) formed in the conveying belt 26*a* to hold the rolled paper P on the conveying belt 26*a* by suction.

To print an image, when the rolled paper P has been conveyed and the printing position of the rolled paper P has reached a location opposite the print head 22K, the print head 22K ejects black ink based on the printing information received from the host PC 12. Similarly, the print head 22C, the print head 22M and the print head 22Y eject cyan, magenta and yellow inks in the named order, and as a result, a color image is printed on the rolled paper P. The printing apparatus 10 includes main tanks 28 (28K, 28C, 28M and 28Y) for storing inks to be supplied to the respective print heads 22, and a pump that supplies these inks to the corresponding print heads 22. Moreover, the printing apparatus 10 also includes a pump that removes air, by suction, from the inside of the closed caps 50 to draw, through the ejection openings of the print heads 22, ink that does not contribute into image printing (suction recovery operation).

Figure 2:
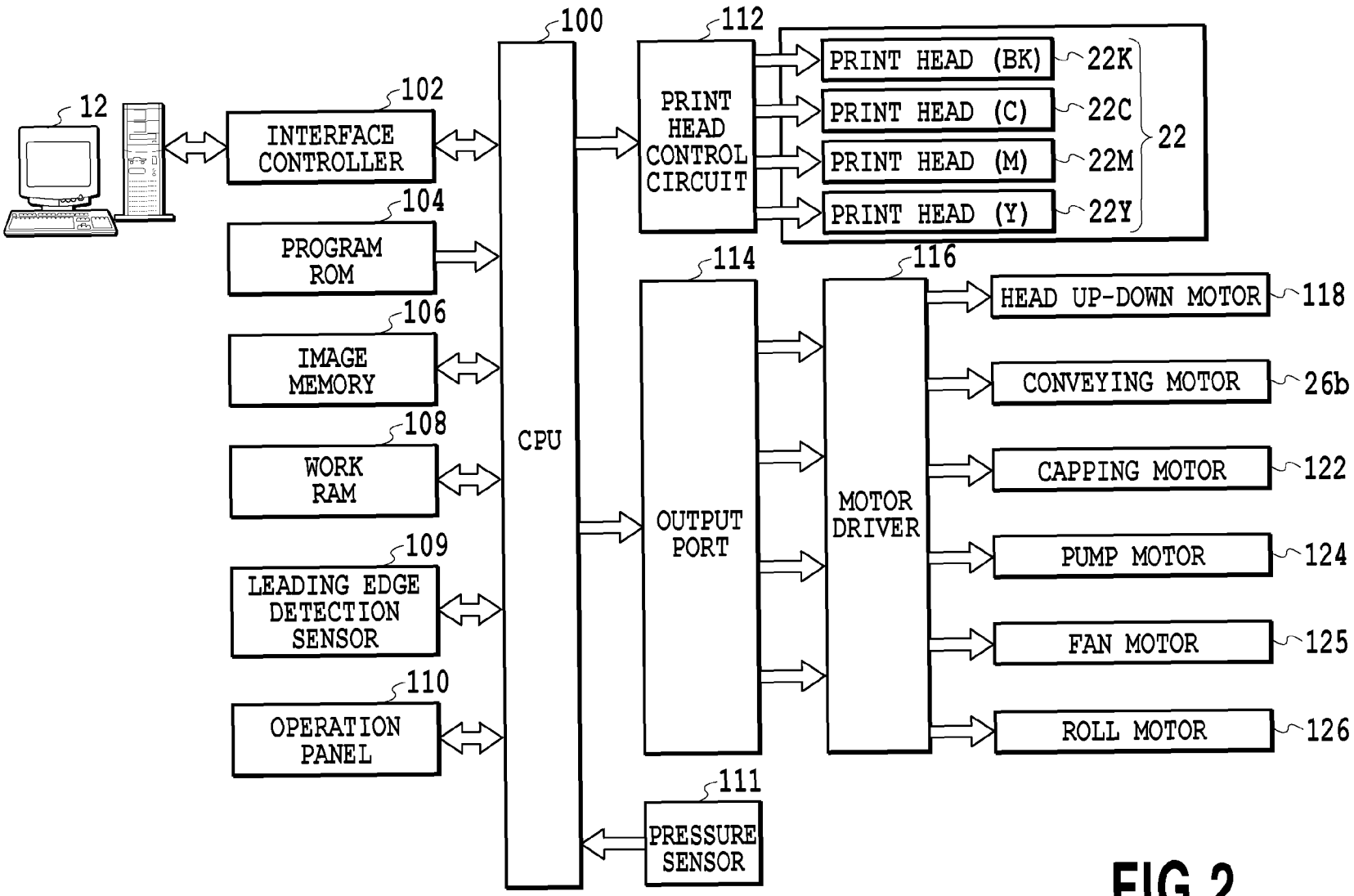
FIG. 2 is a block diagram illustrating a control system of the printing apparatus shown in FIG. 1.

FIG. 2 is a block diagram for explaining a control system of the printing apparatus 10 in FIG. 1. The printing information and a command transmitted by the host PC (host apparatus) 12 are received by a CPU 100 via an interface controller 102. The CPU 100 is an operation processing apparatus that undertakes a general control for the printing apparatus 10, e.g., receives the printing information for the printing apparatus 10, performs the printing operation, or performs handling of the rolled paper P. The CPU 100 analyzes a received command, and thereafter, converts image data for individual color components of print data into bit map data, and expands the bit map data in an image memory 106. Before printing is started, the CPU 100 drives a capping motor 122 and a head up-down motor 118 through an output port 114 and a motor driver 116 to separate the print heads 22K, 22C, 22M and 22Y from the corresponding caps 50 and move these print heads 22 to the printing positions. The CPU 100 drives the capping motor 122 to move the recovery gutter 54. As a result, the blade 60 is moved to wipe the ejection faces 23, and further, is brought in contact with the blade cleaners 70 in order to remove foreign substances attached to the blade 60. Furthermore, the CPU 100 drives, through the output port 114 and the motor driver 116, a roll motor 126 for feeding the rolled paper P and the conveying motor 26*b* for conveying the rolled paper P, so that the rolled paper P is to be conveyed to the printing position.

When printing of an image is started, a leading edge detection sensor 109 detects the location of a leading edge of the rolled paper P conveyed to the conveying mechanism 26 in order to determine the timing (printing timing) at which ink should be ejected to the rolled paper P that is conveyed at a constant speed in the direction indicated by the arrow A. Thereafter, in synchronization with conveying of the rolled paper P, the CPU 100 sequentially reads print data from the image memory 106, and transfers the print data to the corresponding print heads 22K, 22C, 22M and 22Y via a print head control circuit 112.

The processing of the CPU 100 is performed based on a processing program stored in a program ROM 104. A processing program and a table associated with a control process flow are stored in the program ROM 104. Further, the CPU 100 employs a work RAM 108 as a work memory. Moreover, in the cleaning operation and the recovery operation performed for the print heads 22, the CPU 100 drives a pump motor 124 via the output port 114 and the motor driver 116 to apply pressure to ink and to draw ink by suction. A fan motor 125 is a motor that drives a rolled paper suction fan, which is included in a suction mechanism described above.

FIG. 3A is a schematic diagram illustrating a structure of a portion around the cap 50 for the recovery unit 40. As described above, the cap 50 is prepared in the recovery gutter 54, and as shown in FIG. 3A, when the print head 22 is moved relative to the recovery gutter 54, the cap 50 closely contacts the ejection face 23, and thus, the capped state is provided by the cap 50. In this capped state, when a negative pressure generated by the pump motor 124 is introduced into the cap 50, ink that does not contribute into printing of the image can be drawn by suction, and be discharged through the ejection openings of the print head 22.

In the recovery gutter 54, the blade 60 for wiping the ejection faces 23 of the print heads 22 is arranged by employing the blade holding member 53. The blade 60 is formed of a flexible plate member. The blade 60 and the print heads 22 are moved relative to each other in directions indicated by a double-headed arrow C along the arrangement of the ejection openings formed in the ejection faces 23 (a direction crossing the conveying direction A), and distal ends of the blade 60 wipe the ejection faces 23. As a result, foreign substances, such as dust and an ink droplet, can be removed from the ejection faces 23. So long as at least either the print heads 22 or the blade 60 moves in the directions indicated by the arrow C, wiping can be performed. For example, the blade 60 may be moved together with the recovery gutter 54 and the blade holding member 53, or may be moved separately from the recovery gutter 54, but together with the blade holding member 53.

Figure 3B:
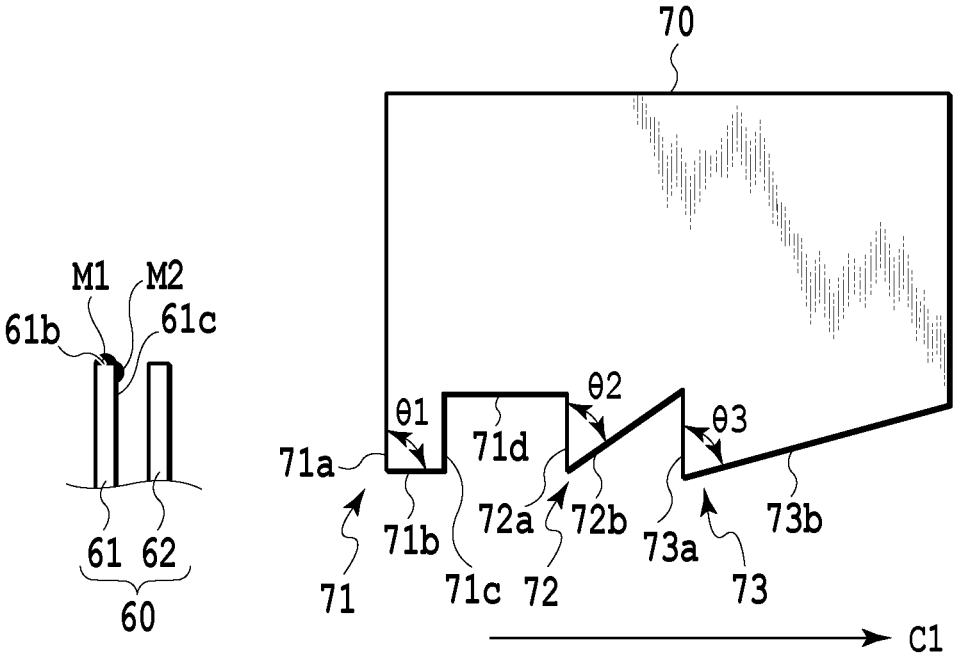
FIG. 3B is a schematic diagram illustrating the portion around the cap in FIG. 1.
Figure 4A:
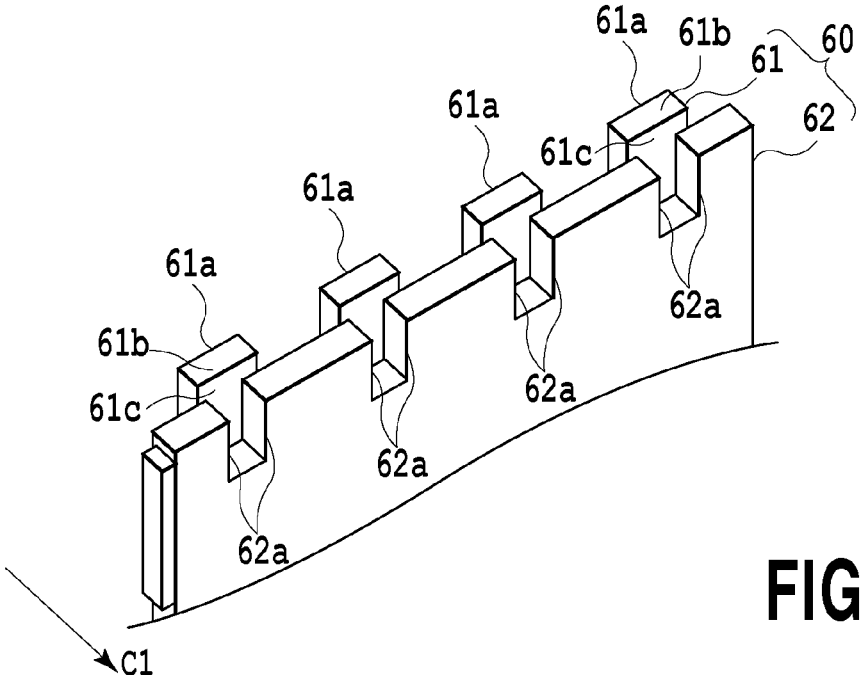
FIG. 4A is a diagram for explaining a blade shown in FIG. 3A.
Figure 4B:
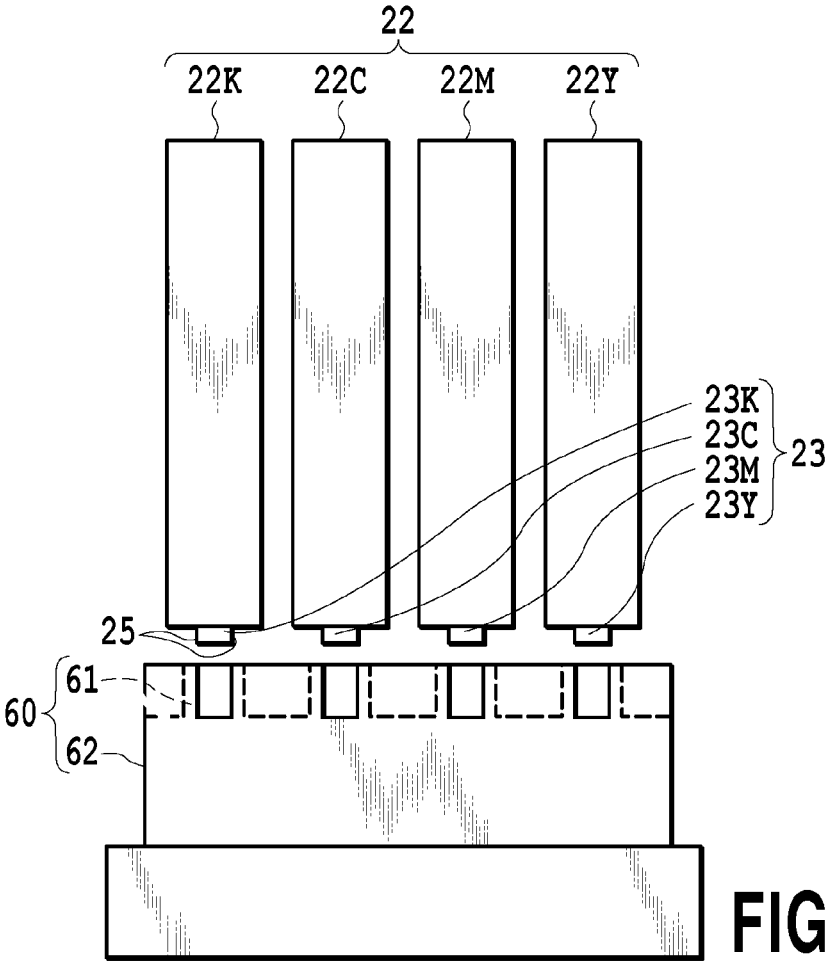
FIG. 4B is a diagram for explaining the blade in FIG. 3A.

As shown in FIGS. 4A and 4B, the blade 60 in this embodiment has a two-plate structure that includes a first blade 61 for wiping the ejection faces 23 of the print heads 22, a second blade 62 for wiping side faces 25 of the print heads 22. The first blade 61 has upper face portions 61*a* that are opposed to the ejection faces 23 (23K, 23C, 23M and 23Y) of the individual print heads 22 (22K, 22C, 22M and 22Y). The second blade 62 has side face portions 62*a* that are opposed to the side faces 25 of the individual print heads 22 (22K, 22C, 22M and 22Y). When the first blade 61 wipes the ejection face 23, a foreign substance M1 is attached to a top face (distal end face) 61*b* at a distal end that is free end, as shown in FIG. 3B, while a foreign substance M2 is attached to a side face 61*c*. The foreign substances M1 and M2 are, for example, dust or ink droplets, and tiny air bubbles may also be collected together. The side face 61*c* is the face that crosses the directions in which the blade 60 moves relative to the blade cleaners 70 (directions indicated by an arrow C1), and when a distal end portion of the side face 61*c* contacts the ejection face 23, the foreign substance is removed from the ejection face 23. The blade 60 may be a single blade for wiping the ejection faces 23, or a single blade for wiping both the ejection faces 23 and the side faces 25.

As described above, the blade cleaner 70 is prepared for the print head 22, and when the blade 60 is moved in a direction indicated by the arrow C1 while contacting the blade cleaner 70, the foreign substance attached to the blade 60 can be removed. As for wiping, the blade 60 and the blade cleaner 70 need only be moved relatively to each other in the direction indicated by the arrow C1, and either the blade 60 or the blade cleaner 70 may be moved to displace the blade 60, relative to the blade cleaner 70, in the direction indicated by the arrow C1. The blade cleaner 70 can be provided by employing a hard absorber that can absorb ink. In this embodiment, the blade cleaner 70 has, on the face opposed to the blade 60, a raised portion including first, second and third ridge portions 71, 72 and 73 shown in FIG. 3B, and different inclination angles θ1, θ2 and θ3 are set for the individual ridge portions. In this embodiment, θ1 is 90 degrees, while θ2 and θ3 are acute angles less than 90 degrees, and a relationship of θ2<θ3 is established. Further, when the ejection face 23 is a horizontal face, faces 71*a* and 71*c* of the ridge portion 71 are vertical faces, and faces 71*b* and 71*d* are horizontal faces. Similarly, a face 72*a* of the ridge portion 72 is vertical and a face 72*b* is inclined, while a face 73*a* of the ridge portion 73 is vertical, and a face 73*b* is inclined. The inclined faces 72*b* and 73*b* are located by being shifted in the direction in which the blade 60 and the blade cleaner 70 are moved relatively to each other, and are inclined with different angles in the direction of the relative movement. The inclination angle of the inclined face 72*b*, relative to the direction in which the blade 60 and the blade cleaner 70 are moved relatively to each other, is greater than the inclination angle of the inclined face 73*b*. The inclined faces 72*b* and 73*b* are formed, so that the radius of curvature of a bent portion of the blade 60 is increased when the blade 60 moves from upstream to downstream in the direction in which the blade 60 moves relative to the blade cleaner 70 (the direction indicated by the arrow C1). Furthermore, the inclined face 72*b* is formed, so that when the blade 60 is moved in the traveling direction (the direction indicated by the arrow C1), the change of the radius of curvature of the bent portion of the blade 60 is greater than the change for the inclined face 73*b*.

The blade cleaners 70 are extended totally across the entire blade 60 in the widthwise direction (the crosswise direction in FIG. 4B), and clean the first and the second blades 61 and 62 in the same manner. Particularly, the blade cleaner 70 can appropriately remove the foreign substances M1 and M2 from the top face 61*b* and the side faces 61*c* at the distal end of the first blade 61.

The cleaning operation for the blade 60 employing the blade cleaner 70 will now be described based on FIG. 5. Since the first and the second blades 61 and 62 are to be cleaned in the same manner, the cleaning operation for the first blade 61 will be typically described.

Figure 5:
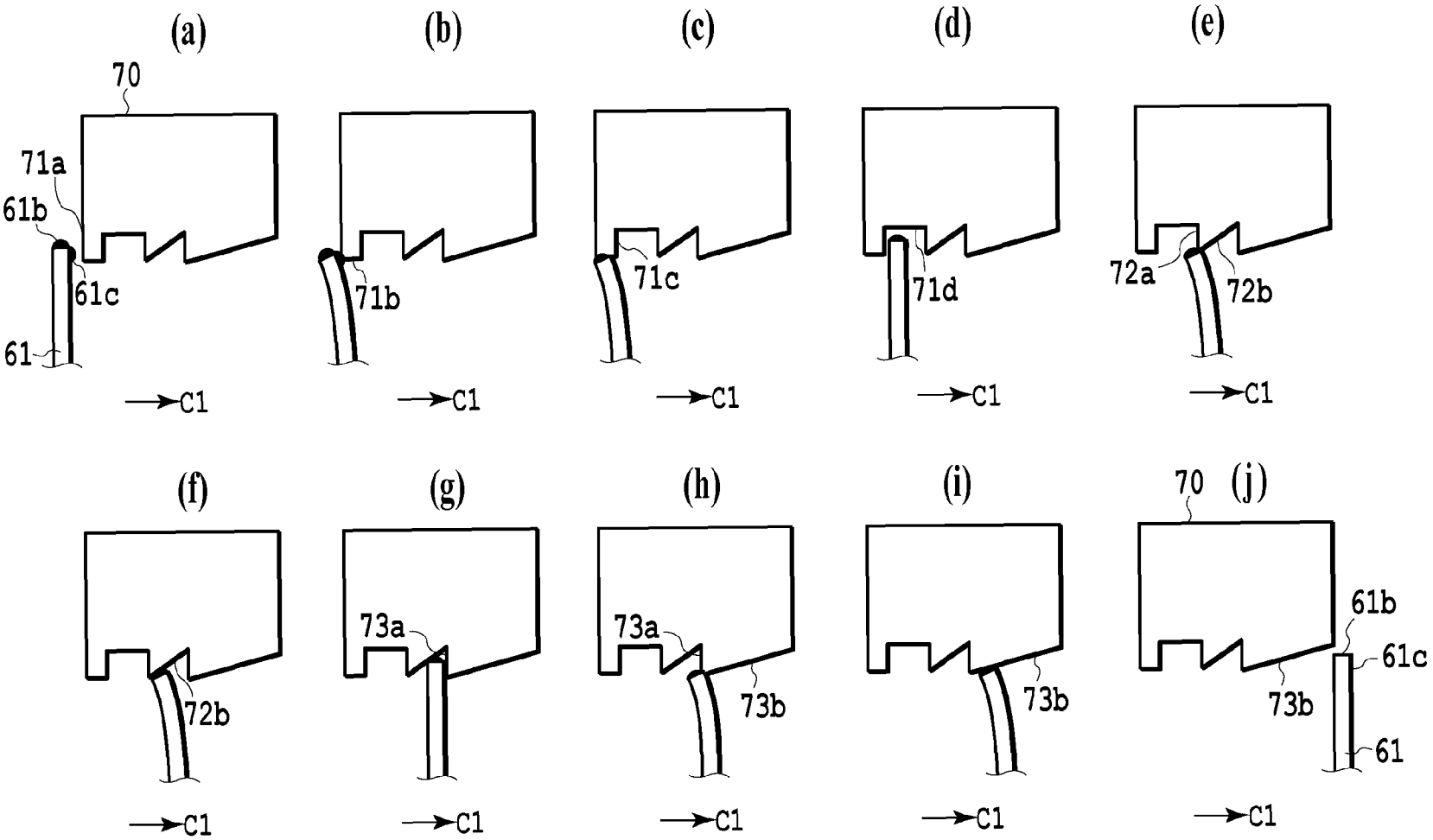
FIG. 5 is a diagram for explaining a blade cleaning operation performed in the first embodiment of the present invention.

When the first blade 61 moves, relative to the blade cleaner 70, in the direction indicated by the arrow C1, first, the first blade 61 is bent and moved while the side face 61*c* contacts the vertical face 71*a* of the blade cleaner 70 (parts (a) and (b) of FIG. 5). Thereafter, the blade 61 is moved with the top face 61*b* contacting the horizontal face 71*b*, and reaches the position opposite the horizontal face 71*d* (parts (c) and (d) of FIG. 5). Sequentially, the blade 61 moves with the side face 61*c* contacting the vertical face 72*a*, and thereafter, moves with the top face 61*b* sliding along the inclined face 72*b* (parts (e), (f) and (g) of FIG. 5). Thereafter, the blade 61 moves with the side face 61*c* contacting the vertical face 73*a*, and moves with the top face 61*b* sliding along the inclined face 73*b* (parts (h), (i) and (j) of FIG. 5).

When the blade 61 is moved while contacting the three ridge portions 71, 72 and 73, the foreign substances M1 and M2 attached to the top face 61*b* and the side face 61*c* are removed by the blade cleaner 70. The foreign substance M2 attached to the side face 61*c* of the blade 61 is removed mainly by the vertical faces 71*a*, 72*a* and 73*a* of the blade cleaner 70, and the foreign substance M1 attached to the top face 61*b* is removed mainly by the horizontal face 71*b* and the inclined faces 72*b* and 73*b* of the blade cleaner 70.

Since these faces 71*b*, 72*b* and 73*b* are provided with different angles θ1, θ2 and θ3 in the perpendicular direction, a state wherein the top face 61*b* of the first blade 61 is opposed to the faces 71*b*, 72*b* and 73*b* is changed. The change of the opposed state includes a change of the angle formed by the face 71*b*, 72*b* or 73*b* and the top face 61*b*, a change of a state wherein the first blade 61 is bent, and a change of a contact pressure. Since such an opposed state is changed, the foreign substance M1 can be appropriately removed from the top face 61*b* of the blade 61, regardless of the size of the foreign substance M1 and the strength of the attachment. Further, for the second and third ridge portions 72 and 73, distal end portions with an acute angle (cornered portions) are formed by the inclined faces 72*b* and 73*b* and the adjacent vertical faces 72*a* and 73*a*. Since the distal end portions contact the top face 61*b* and the side face 61*c* of the first blade 61 to scrape the foreign substances M1 and M2 from the top face 61*b* and the side face 61*c*, these foreign substances can be more appropriately removed.

At step in part (d) of FIG. 5, the blade 61 may be moved close to the blade cleaner 70, so that the top face 61*b* of the first blade 61 contacts the horizontal face 71*d* of the blade cleaner 70. When the top face 61*b* of the blade 61 is encouraged to contact the horizontal face 71*d* in this manner, the top face 61*b* can be more appropriately cleaned. When the top face 61*b* of the first blade 61 is to contact the horizontal face 71*d*, the movement of the first blade 61 in the direction indicated by the arrow C1 may be temporarily halted.

Second Embodiment

Figure 6:
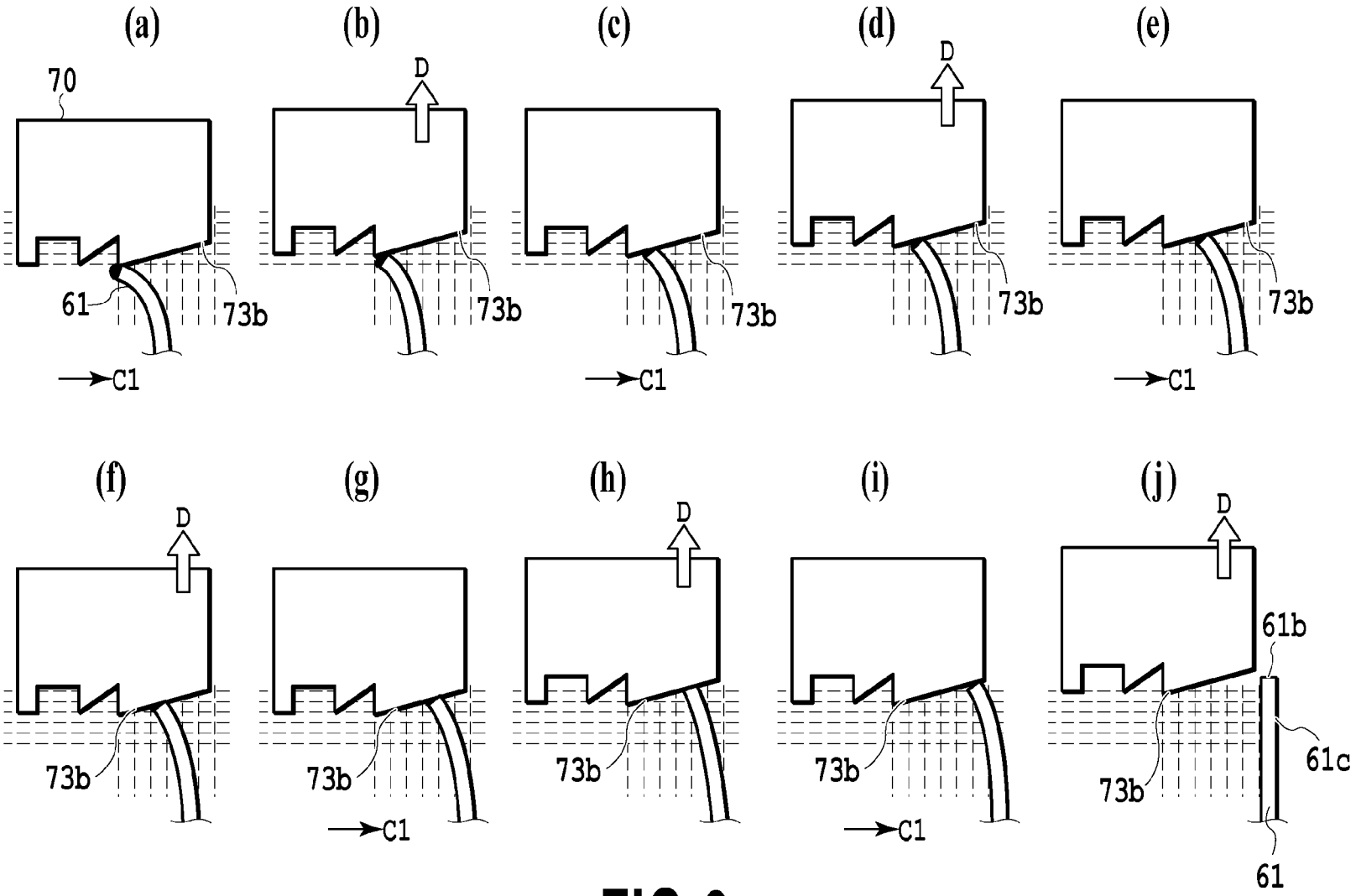
FIG. 6 is a diagram for explaining a blade cleaning operation performed in a second embodiment of the present invention.

FIG. 6 is a diagram for explaining an operation for cleaning the blade 60 for a second embodiment of the present invention, but an explanation will not be given for the same process steps as those for the first embodiment.

Part (a) of FIG. 6 shows the state wherein, after the same process beginning from part (a) to part (e) of FIG. 5 in the first embodiment has been performed, the first blade 61 is moved in the direction indicated by the arrow C1 with the top face 61 sliding across the inclined face 73*b*. Thereafter, a movement of the blade cleaner 70 in a direction indicated by an arrow D (parts (b), (d), (f), (h) and (j) of FIG. 6) and the movement of the first blade 61 in the direction indicated by the arrow C1 (parts (c), (e), (g) and (i) of FIG. 6) are alternately performed. When the blade cleaner 70 is moved away from the first blade 61, step by step, in the direction indicated by the arrow D in this manner, a state wherein the top face 61*b* of the first blade 61 is opposed to the inclined face 73*b* is changed. As a result, the top face 61*b* of the first blade 61 can be more appropriately cleaned.

The movement of the blade cleaner 70 to be separated apart from the first blade 61 is performed when the CPU 100 (control means) permits the head up-down motor 118 (see FIG. 2) to control a mechanism (moving mechanism) that elevates or lowers the print head 22. The blade 60 and the blade cleaner 70 need only be moved relative to each other in the direction indicated by the arrow D, and the CPU 100 may either the blade 60 or the blade cleaner 70 so long as at least the blade cleaner 70 can be separated from the blade 60 in the direction indicated by the arrow D. Further, the CPU 100 may perform, at least partially, both of the movement of the blade cleaner 70 in the direction indicated by the arrow D and the movement of the blade 60 in the direction indicated by the arrow C1 at the same time.

Third Embodiment

Figure 7:
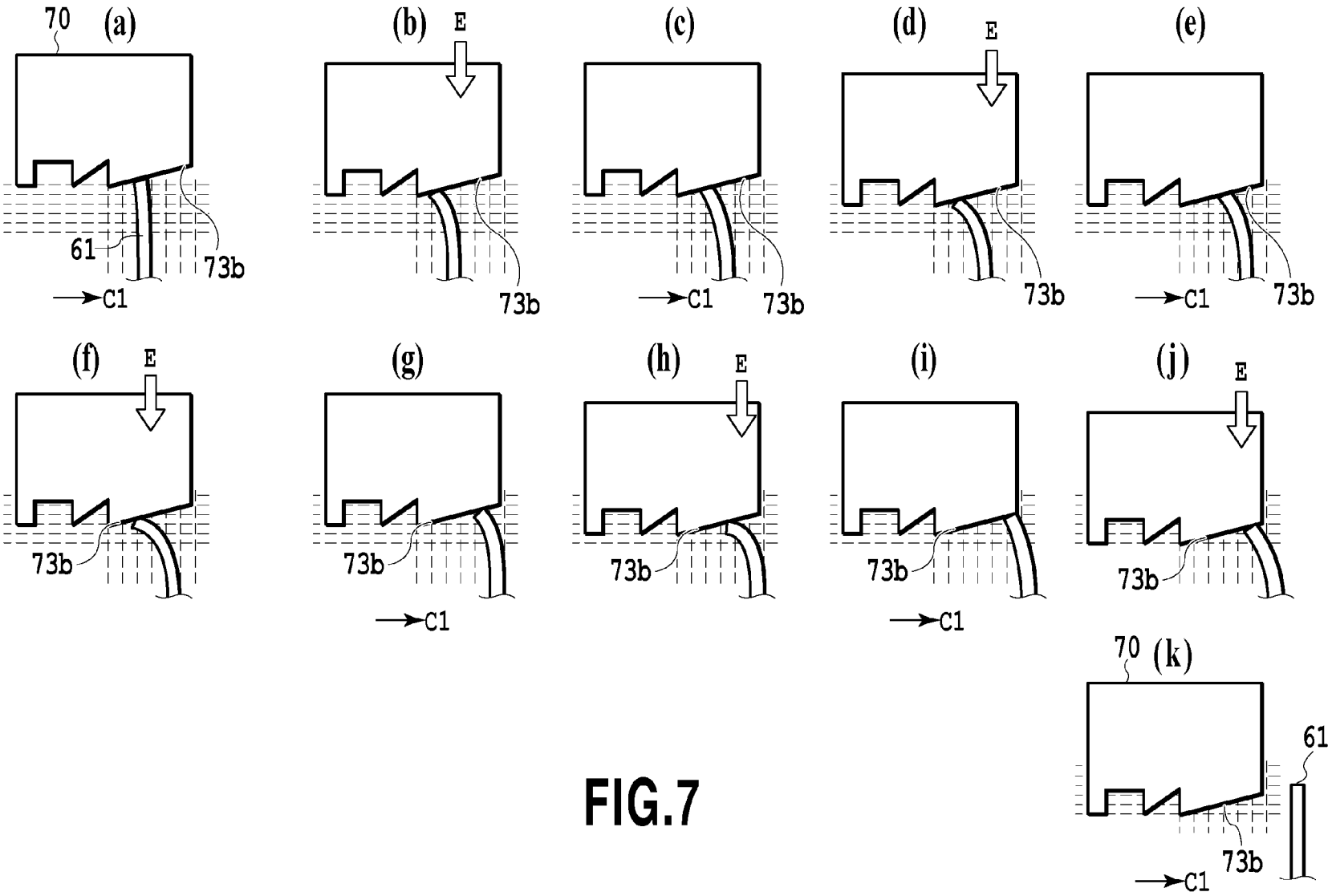
FIG. 7 is a diagram for explaining a blade cleaning operation performed in a third embodiment of the present invention.

FIG. 7 is a diagram for explaining an operation for cleaning the blade 60 for a third embodiment of the present invention, but an explanation will not be given for the same process steps as those for the first embodiment.

Part (a) of FIG. 7 shows the state wherein, after the same process beginning from part (a) to part (e) of FIG. 5 in the first embodiment has been performed, the first blade 61 is moved in the direction indicated by the arrow C1 with the top face 61 sliding across the inclined face 73*b*. Thereafter, a movement of the blade cleaner 70 in a direction indicated by an arrow E (parts (b), (d), (f), (h) and (j) of FIG. 7) and the movement of the first blade 61 in the direction indicated by the arrow C1 (parts (c), (e), (g), (i) and (k) of FIG. 7) are alternately performed. When the blade cleaner 70 is gradually moved, in this manner, in the direction indicated by the arrow E to contact the first blade 61, a state wherein the top face 61*b* of the first blade 61 is opposed to the inclined face 73*b* is changed, and a period wherein the first blade 61 contacts the inclined face 73*b* can be extended. As a result, the top face 61*b* of the first blade 61 can be more appropriately cleaned.

The movement of the blade cleaner 70 close to the first blade 61 is performed when the CPU 100 (control means) permits the head up-down motor 118 (see FIG. 2) to control a mechanism (moving mechanism) that elevates or lowers the print head 22. The blade 60 and the blade cleaner 70 need only be moved relative to each other in the direction indicated by the arrow E, and so long as at least the blade cleaner 70 can be brought in contact with the blade 60 in the direction indicated by the arrow E, the CPU 100 may move either the blade 60 or the blade cleaner 70. Further, the CPU 100 may perform, at least partially, both of the movement of the blade cleaner 70 in the direction indicated by the arrow E and the movement of the first blade 60 in the direction indicated by the arrow C1 at the same time.

Fourth Embodiment

Figure 8:
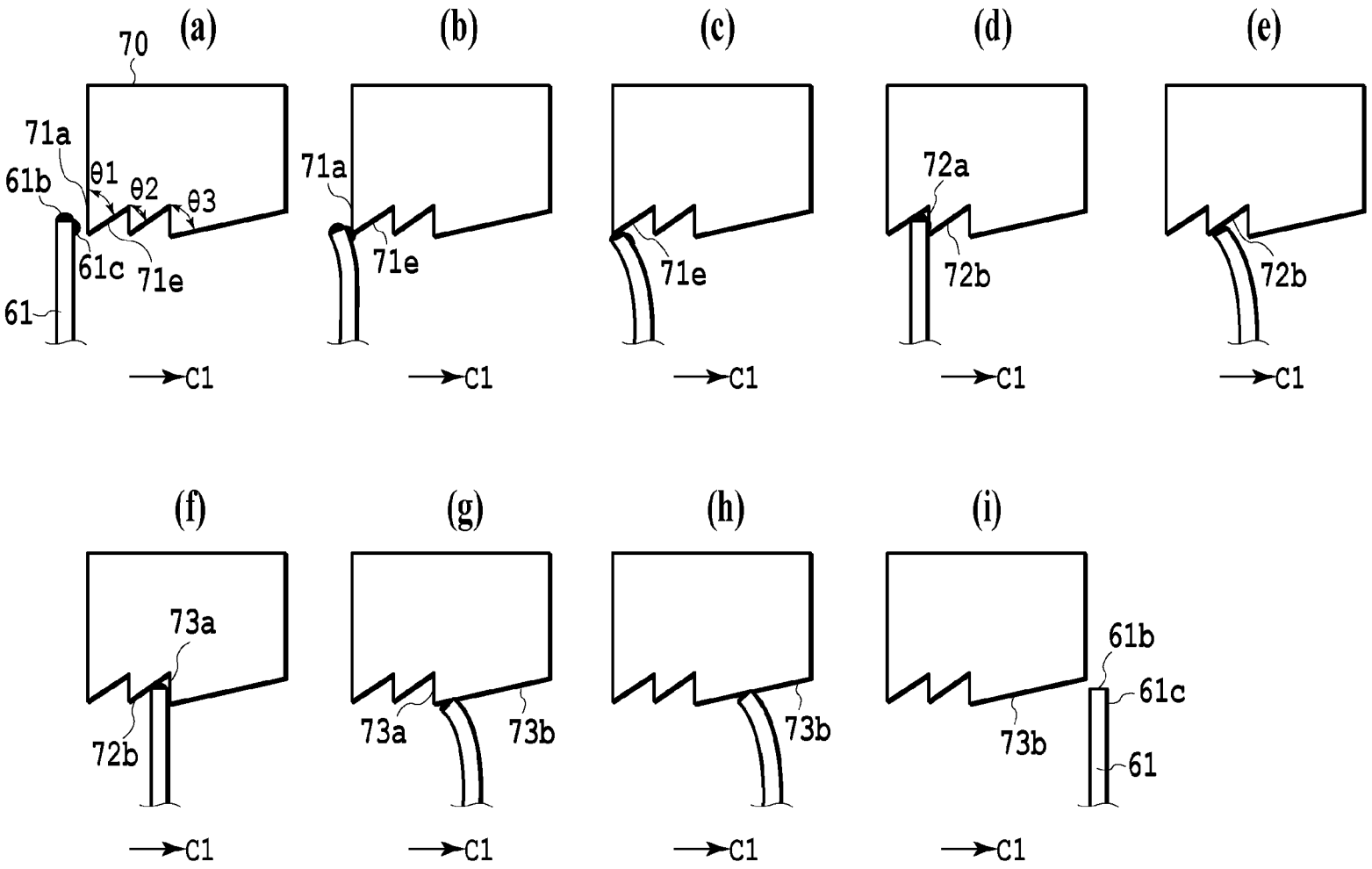
FIG. 8 is a diagram for explaining a blade cleaning operation performed in a fourth embodiment of the present invention.

FIG. 8 is a diagram for explaining an operation for cleaning the blade 60 for a fourth embodiment of the present invention, but an explanation will not be given for the same process steps as those for the first embodiment. For the blade cleaner 70 for this embodiment, the angle θ1 is an acute angle less than 90 degrees, and an inclined face 71*e* is formed, instead of the horizontal face 71*b*, the vertical face 71*c* and the horizontal face 71*d* of the above described embodiments. Further, θ1, θ2 and θ3 are set to different angles. In this embodiment, a relationship of θ1<θ2<θ3 is established.

For the cleaning operation for the blade 60, when the first blade 61 starts to move, relative to the blade cleaner 70, in the direction indicated by an arrow C1, first, the first blade 61 is bent while the side face 61*c* contact the vertical face 71*a* of the blade cleaner 70 (parts (a) and (b) of FIG. 8). Thereafter, the first blade 61 is moved with the top face 61*b* contacting the inclined face 71*e* (part (c) of FIG. 8). Sequentially, the first blade 61 moves with the side face 61*c* contacting the vertical face 72*a*, and thereafter, moves with the top face 61*b* sliding along the inclined face 72*b* (parts (d) and (e) of FIG. 8). Thereafter, the first blade 61 moves with the side face 61*c* contacting the vertical face 73*a*, and moves with the top face 61*b* sliding along the inclined face 73*b* (parts (f), (g), (h) and (i) of FIG. 8). This cleaning operation is controlled by the CPU 100.

In this embodiment, as well as the embodiments described above, since the inclined faces 71*e*, 72*b* and 73*b* are provided with different angles θ1, θ2 and θ3 in the perpendicular direction, a state wherein the top face 61*b* of the first blade is opposed to the faces 71*e*, 72*b* and 73*b* is changed. Similarly to the above described embodiments, because of the change of the opposed state of the first blade 61, the foreign substance M1 can be appropriately removed from the top face 61*b* of the first blade 61. Furthermore, foreign substances M1 and M2 attached to the top face 61*b* and the side face 61*c* of the first blade 61 can also be scraped off by the acute angled distal end portion of the first ridge portion 71.

Fifth Embodiment

Figure 9:
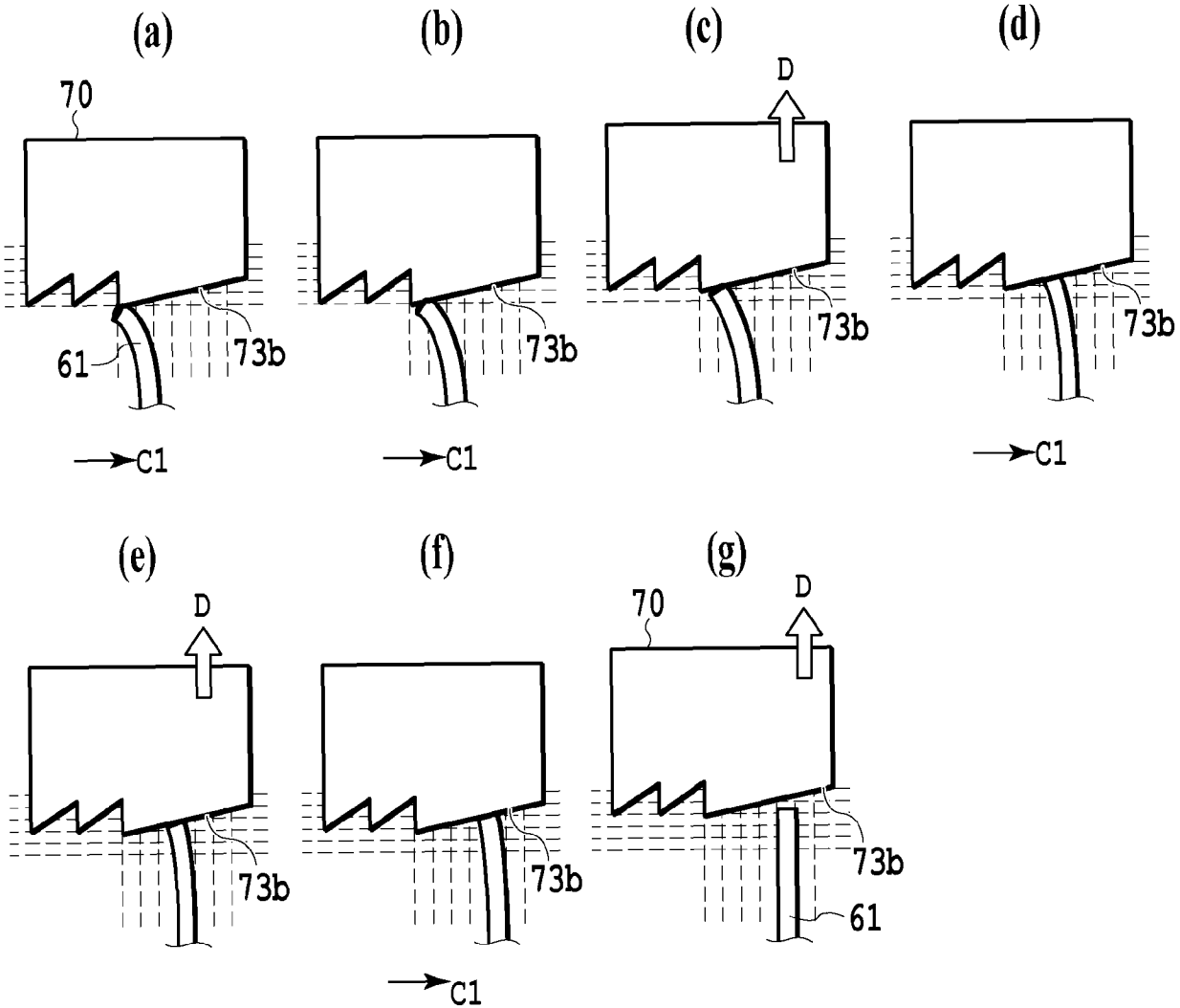
FIG. 9 is a diagram for explaining the movement of a blade for cleaning according to a fifth embodiment of the present invention.

FIG. 9 is a diagram for explaining an operation for cleaning the blade 60 for a fifth embodiment of the present invention, but an explanation will not be given for the same process steps as those for the fourth embodiment.

Parts (a) and (b) of FIG. 9 show a state wherein, after the same process beginning from part (a) to part (f) of FIG. 8 in the fourth embodiment has been performed, the first blade 61 is moved in the direction indicated by the arrow C1 with the top face 61*b* sliding across the inclined face 73*b*. Thereafter, the movement of the blade cleaner 70 in a direction indicated by an arrow D (parts (c), (e) and (g) of FIG. 9) and the movement of the first blade 61 in the direction indicated by the arrow C1 (parts (d) and (f) of FIG. 9) are alternately performed. When the blade cleaner 70 is moved away from the first blade 61, step by step, in the direction indicated by the arrow D in this manner, a state wherein the top face 61*b* of the first blade 61 is opposed to the inclined face 73*b* is changed. As a result, the top face 61*b* of the first blade 61 can be more appropriately cleaned. This cleaning operation is controlled by a CPU 100.

The blade 60 and the blade cleaner 70 need only be moved relative to each other in the direction indicated by the arrow D, and so long as at least the blade cleaner 70 can be separated from the blade 60 in the direction indicated by the arrow D, the CPU 100 may move either the blade 60 or the blade cleaner 70. Further, the CPU 100 may perform, at least partially, both of the movement of the blade cleaner 70 in the direction indicated by the arrow D and the movement of the blade 60 in the direction indicated by the arrow C1 at the same time.

Sixth Embodiment

Figure 10:
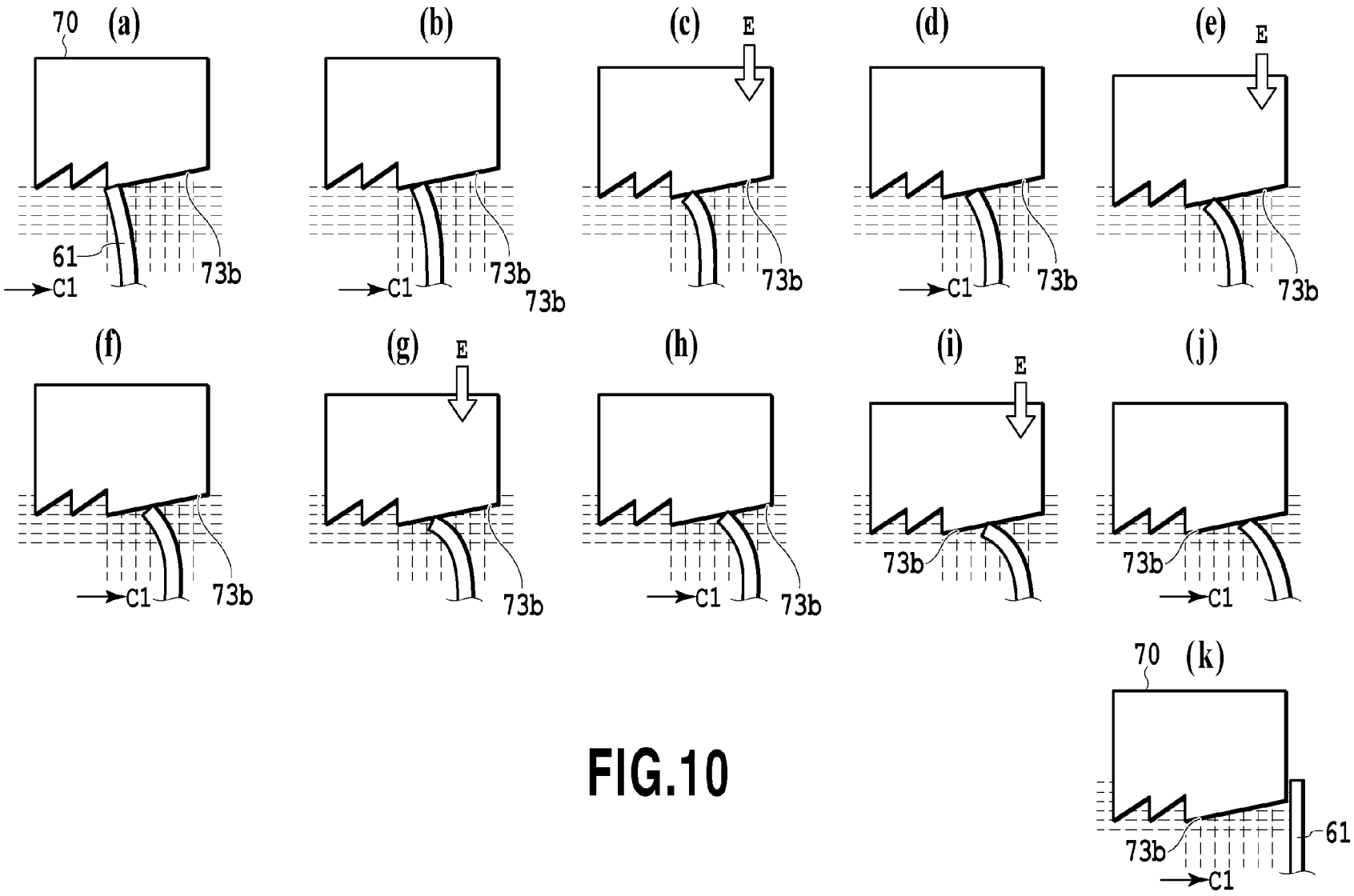
FIG. 10 is a diagram for explaining a blade cleaning operation performed in a sixth embodiment of the present invention.

FIG. 10 is a diagram for explaining an operation for cleaning the blade 60 for a sixth embodiment of the present invention, but an explanation will not be given for the same process steps as those for the fourth embodiment.

Parts (a) and (b) of FIG. 10 show a state wherein, after the same process beginning from part (a) to part (f) of FIG. 8 in the fourth embodiment has been performed, the first blade 61 is moved in the direction indicated by an arrow C1 with the top face 61*c* sliding across the inclined face 73*b*. Thereafter, the movement of the blade cleaner 70 in a direction indicated by an arrow E (parts (c), (e), (g) and (i) of FIG. 10) and the movement of the first blade 61 in the direction indicated by the arrow C1 (parts (d), (f), (h), (j) and (k) of FIG. 10) are alternately performed. When the blade cleaner 70 is gradually moved, in this manner, in the direction indicated by the arrow E to contact the first blade 61, a state wherein the top face 61*b* of the first blade 61 is opposed to the inclined face 73*b* is changed, and a period wherein the first blade 61 contacts the inclined face 73*b* can be extended. As a result, the top face 61*b* of the first blade 61 can be more appropriately cleaned. This cleaning operation is controlled by a CPU 100.

The blade 60 and the blade cleaner 70 need only be moved relative to each other in the direction indicated by the arrow E, and so long as at least the blade cleaner 70 can be brought in contact with the blade 60 in the direction indicated by the arrow E, the CPU 100 may move either the blade 60 or the blade cleaner 70. Further, the CPU 100 may perform, at least partially, both of the movement of the blade cleaner 70 in the direction indicated by the arrow E and the movement of the blade 60 in the direction indicated by the arrow C1 at the same time.

Other Embodiment

The present invention can be applied not only for the above described full-line type ink jet printing apparatus, but also for various other types of ink jet printing apparatuses, such as serial scan type. A serial scan type ink jet printing apparatus prints an image on a printing medium by moving a print head in a main scan direction and conveying the printing medium in a sub-scan direction that crosses the main scan direction.

The blade cleaner may include a plurality of inclined faces, which are located opposite the distal end of the blade by being shifted in the direction in which the blade is moved relative to the blade cleaner, and which are inclined in the direction in which the blade is moved relative to the blade cleaner. Even when these inclined faces are provided at the same angle, the distal end of the blade, especially, the top face portion of the blade can be appropriately cleaned. This is because a state wherein the plurality of inclined faces contact the distal end of the blade and a state wherein the top face of the distal end of the blade is opposed to the plurality of inclined faces are changed as the amount of a foreign substance attached to the blade is reduced by cleaning the blade. The contact state and the opposed state can be more steadily changed by preparing different angles for the individual inclined faces of the blade cleaner. Further, a direction in which these faces are inclined is not limited to the direction described in the above embodiments, i.e., the direction in which the distance between the inclined faces and the blade is increased as the blade is moved relative to the blade cleaner. These faces may be inclined in a direction in which the distance between the inclined faces and the blade is reduced as the blade is moved relative to the blade cleaner, and a face that is inclined in a different direction may also be included.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-017133, filed Jan. 31, 2013, which is hereby incorporated by reference herein in its entirety.

What is claimed is:

1. An ink jet printing apparatus for printing an image by employing a print head capable of ejecting ink through an ejection opening, the ink jet printing apparatus comprising:

a blade having an end portion which wipes an ejection opening face of the print head where the ejection opening is formed;

a blade cleaner having a face which moves relative to the blade in a predetermined direction while being in contact with the end portion of the blade; and a moving unit configured to relatively move the blade and the blade cleaner so that the blade and the blade cleaner are moved closer to each other or away from each other in a direction crossing the predetermined direction, wherein the face of the blade cleaner includes a plurality of inclined faces, the plurality of inclined faces being (i) located relative to each other by being shifted in the predetermined direction and (ii) inclined in the predetermined direction, wherein the plurality of inclined faces are inclined so that a distance between the inclined faces and the end portion of the blade is increased in accordance with the relative movement between the blade and the blade cleaner, and wherein the plurality of inclined faces have different inclination angles in the predetermined direction.

2. The ink jet printing apparatus according to claim 1, wherein the end portion of the blade includes a top face and a side face, and wherein a state wherein the top face is opposed to the inclined faces is changed in accordance with the inclination angles of the inclined faces.

3. The ink jet printing apparatus according to claim 1, wherein, at the blade cleaner, at least one of the plurality of inclined faces and a face adjacent thereto form an acute angled corner portion.

4. The ink jet printing apparatus according to claim 1, wherein the blade cleaner includes a flat face which is opposed to the end portion of the blade and is extended in the predetermined direction.

5. The ink jet printing apparatus according to claim 1, further comprising:

a control unit configured to control the moving unit in accordance with the relative movement between the blade and the blade cleaner in the predetermined direction.

6. The ink jet printing apparatus according to claim 1, further comprising:

a control unit configured to perform, alternately, the relative movement between the blade and the blade cleaner in the predetermined direction and the relative movement between the blade and the blade cleaner by the moving unit for moving the blade and the blade cleaner closer to each other.

7. The ink jet printing apparatus according to claim 1, further comprising:

a control unit configured to perform, alternately, the relative movement between the blade and the blade cleaner in the predetermined direction and the relative movement between the blade and the blade cleaner by the moving unit for moving the blade and the blade cleaner away from each other.

8. An ink jet printing apparatus for printing an image by employing a print head capable of ejecting ink through an ejection opening, the ink jet printing apparatus comprising:

a blade having an end portion which wipes an ejection opening face of the print head where the ejection opening is formed;

a blade cleaner having a face which moves relative to the blade in a predetermined direction while being in contact with the end portion of the blade; and a moving unit configured to relatively move the blade and the blade cleaner so that the blade and the blade cleaner are moved closer to each other or away from each other in a direction crossing the predetermined direction, wherein the face of the blade cleaner includes a plurality of inclined faces, the plurality of inclined faces being (i) located relative to each other by being shifted in the predetermined direction and (ii) inclined in the predetermined direction, wherein the plurality of inclined faces are inclined so that a distance between the inclined faces and the end portion of the blade is increased in accordance with the relative movement between the blade and the blade cleaner, and wherein at the blade cleaner, at least one of the plurality of inclined faces and a face adjacent thereto form an acute angled corner portion.

9. An ink jet printing apparatus for printing an image by employing a print head capable of ejecting ink through an ejection opening, the ink jet printing apparatus comprising:

a blade having an end portion which wipes an ejection opening face of the print head where the ejection opening is formed;

a blade cleaner having a face which moves relative to the blade in a predetermined direction while being in contact with the end portion of the blade;

a moving unit configured to relatively move the blade and the blade cleaner so that the blade and the blade cleaner are moved closer to each other or away from each other in a direction crossing the predetermined direction; and a control unit configured to control the moving unit in accordance with the relative movement between the blade and the blade cleaner in the predetermined direction.

* * * * *